US005303432A

United States Patent [19]

Fitts

[11] Patent Number: 5,303,432

[45] Date of Patent: Apr. 19, 1994

[54] CONVERTIBLE FUTON FRAME

[76] Inventor: Dana W. Fitts, 375 College Ave., Excelsior, Minn. 55331

[21] Appl. No.: 9,097

[22] Filed: Jan. 26, 1993

[51] Int. Cl.[5] ..... A47C 17/17

[52] U.S. Cl. ..... 5/37.1; 5/47; 5/57.2

[58] Field of Search ..... 5/37.1, 41, 47, 48, 5/57.2

[56] References Cited

U.S. PATENT DOCUMENTS

| | | | |
|---|---|---|---|
| 3,634,853 | 1/1972 | Hern et al. | 5/37.1 |
| 4,521,927 | 6/1985 | Brunn | 5/37.1 |
| 4,642,823 | 2/1987 | Wiggins | 5/47 |
| 4,829,611 | 5/1989 | Fireman | 5/47 |
| 4,875,244 | 10/1989 | Tremblay | 5/47 X |
| 4,996,730 | 9/1991 | Fireman et al. | 5/37.1 |
| 5,083,333 | 1/1992 | Newton | 5/37.1 |
| 5,129,114 | 7/1992 | Withers | 5/37.1 X |
| 5,153,951 | 10/1992 | Hester | 5/37.1 |

*Primary Examiner*—Michael Trettel

*Attorney, Agent, or Firm*—Merchant, Gould, Smith, Edell, Welter & Schmidt

[57] ABSTRACT

A convertible furniture frame is disclosed which is intended for use with a futon or other resilient cushion. The convertible frame includes opposed arm or end frames interconnected by front and back rails to define a rigid rectangular frame. Seat and back members are movably connected to the rectangular frame and to each other in such a way that an individual can convert the frame between sitting and sleeping positions from a point in front of a frame. By virtue of its construction, the converting mechanism inherently maintains the seat and back members in either position without a separate locking mechanism or additional manipulative functions by the user.

27 Claims, 7 Drawing Sheets

CONVERTIBLE FUTON FRAME

RELATED APPLICATION

This application has subject matter related to the concurrently filed application Ser. No. 08/009104, still pending, the disclosure of which is incorporated by reference.

BACKGROUND OF THE INVENTION

The invention broadly relates to seating devices that may be converted between sitting and lying positions, and is specifically directed to a two section convertible frame intended for use with futons. A three section convertible frame is disclosed in the companion application described above.

The popularity of futons has increased over the past several years because they are relatively inexpensive while at the same time being capable of being used for both sitting and sleeping. This popularity has spawned considerable activity in the development of frames that are adapted for use with futons and which can be converted between sitting and sleeping positions. Thus, a single article of furniture may be used for both a sofa and a bed, which not only reduces the need for and cost of separate articles of furniture, but also permits a single room to provide both living and sleeping functions. Many such convertible frames are now commercially available which generally include back and seat sections that can be moved between sitting and sleeping positions, and these existing devices include a variety of mechanisms of varying degrees of complexity requiring various operations by the user during the converting process.

Currently available futon frames generally suffer with disadvantages in a number of broad respects. First, some lack in sturdiness and stability. It is obviously essential that any article of furniture that provides both sitting and sleeping functions will be used both day and night and will therefore be subject to greater wear. Many existing futon frames are not only manufactured from inexpensive materials, but also are not designed to withstand wear over extended use.

Another problem in the conversion mechanism of many existing futon frames is the need during the conversion process to perform an additional manipulative function or functions in order for the frame to reach the point of rigidity and stability. For example, after the back and seat sections have been moved to the sleeping position, in which they are both horizontally disposed, it is necessary with many prior art devices to make a further manipulation of one of the sections or the mechanism itself to lock both sections in place. The failure to do so may cause the sections to fold up when weight is placed on them.

Another disadvantage with existing convertible futon frames is the requirement either that more than one person be involved in the converting process, or that a single person move from position to position before the converting process can be completed.

Another problem with many existing futon frames is release of the back section by the conversion mechanism during conversion but before conversion is completed. This typically occurs as the seat section is lifted to initiate conversion, and as the back section is accordingly tilted toward horizontal from its upright position, it is released and falls by gravity, striking the frame. This causes stress to the frame which may eventually damage it. The problem may be overcome with the assistance of a second person, who must position himself/herself to catch the back section as it is released.

Yet another disadvantage with prior art devices is the difficulty in manufacturing. Because most futon frames are formed primarily from wooden components, many current designs include metal components for reinforcement purposes. This makes the manufacturing process more complex and increases the cost of the device through increased labor and more expensive parts. Further, convertible futon frames that use a number of metal components are less attractive from the aesthetic standpoint, and are therefore less desirable to consumers.

The inventive convertible futon frame solves most of these problems. The disclosed frame includes first and second arm or end frames that are interconnected by front and rear cross rails, resulting in a sturdy rectangular frame. Back and seat members are carried by this stationary frame for movement between sitting and lying positions. Each of these members is generally rectangular in the preferred embodiment having front and rear sides and opposed ends. Specifically, the back member includes pivot pins that project laterally outward from each end proximate its lower or front side, and which guidably slide in elongated horizontal grooves formed in the arm end frames. The back member is also supported by a pair of metal straps that are pivotally connected between each of its ends and each of the end frames.

The seat member is pivotally connected along its rear side to the front side of the back section by a pair of pivot pins that project laterally from each end of the back member and which are slidably retained in short grooves formed in the ends of the seat member, permitting relative linear as well as pivotal movement. Abutment members are secured to each end of member which engage the back seat member in the sitting position to prevent relative rotation to the open or sleeping position. The seat member may be moved linearly out of engagement with the abutment member by virtue of the pin/short groove relationship, which permits the seat and back members to be relatively rotated to the open or sleeping position.

Based on this unique construction, a single person may quickly and easily move the convertible frame from the sitting to the sleeping position and vice versa from a single standing position in the front of the frame. Further, because of the unique construction and position of the strap members, the seat and back members are both rigidly held in both the sitting and sleeping positions without additional detent or locking mechanisms. All that is necessary is for the user to grasp the front edge of the seat member in either the sitting or lying position, and to make relatively simple movements with the seat member from a single position that accomplish the desired objective. Further, downward pressure resulting from the weight of both the futon and the user tends to retain the back and seat members in the chosen position, resulting in greater support and stability but without adversely affecting subsequent operations to the opposite position.

The inventive convertible frame is also designed to distribute the forces generated over the various components during seating, sleeping and conversion between positions, which enables the device to operate with a minimum of components other than wood. Metal reinforcing plates are therefore unnecessary, which simplifies the manufacturing process and reduces the cost of manufacture, all without compromising rigidity and stability. The fact that the inventive frame can be fabricated predominantly from hardwood components results in a frame that is aesthetically pleasing and hence more attractive to purchasers.

DETAILED DESCRIPTION OF THE PREFERRED EMBODIMENT

Figure 1:
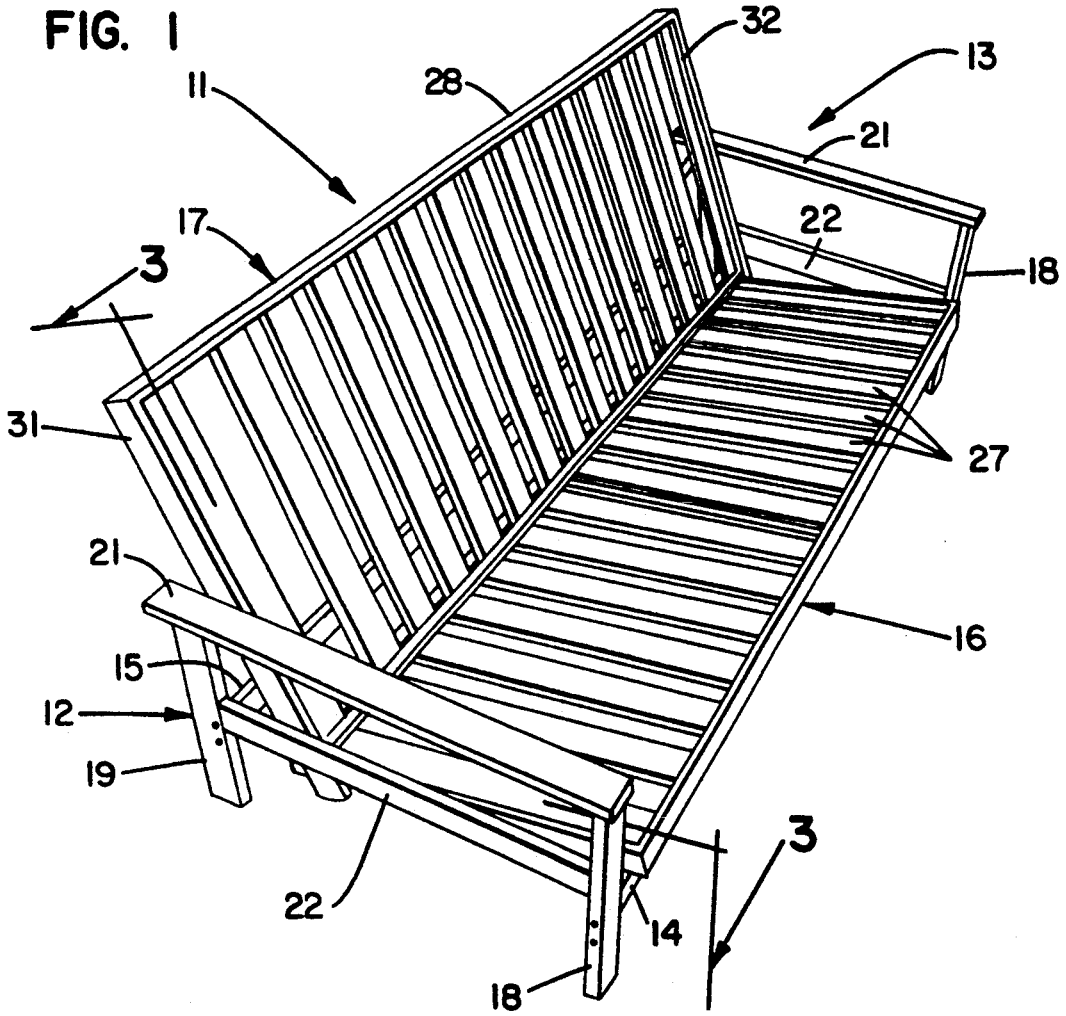
FIG. 1 is a perspective view of the convertible futon frame embodying the invention.
Figure 2:
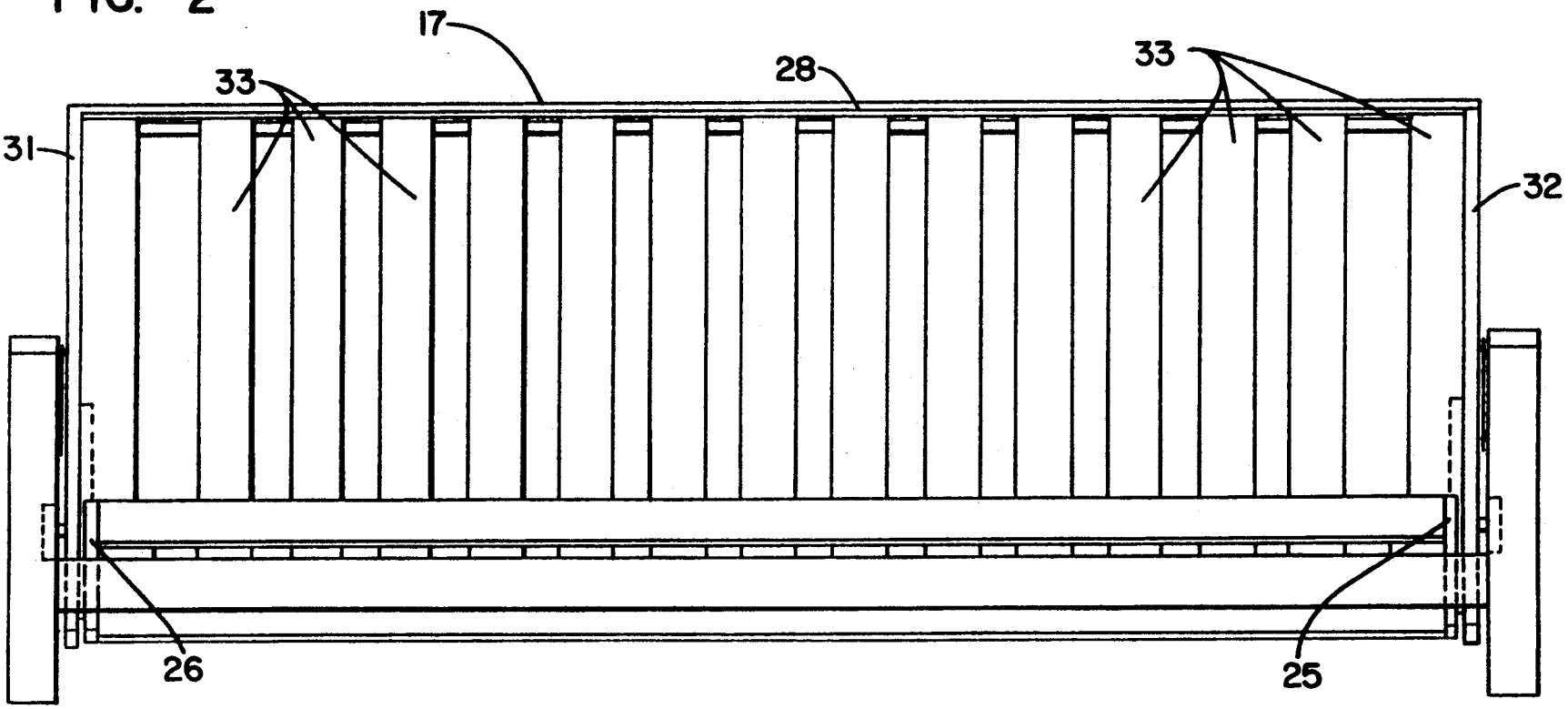
FIG. 2 is a front elevation of the convertible futon frame.
Figure 4:
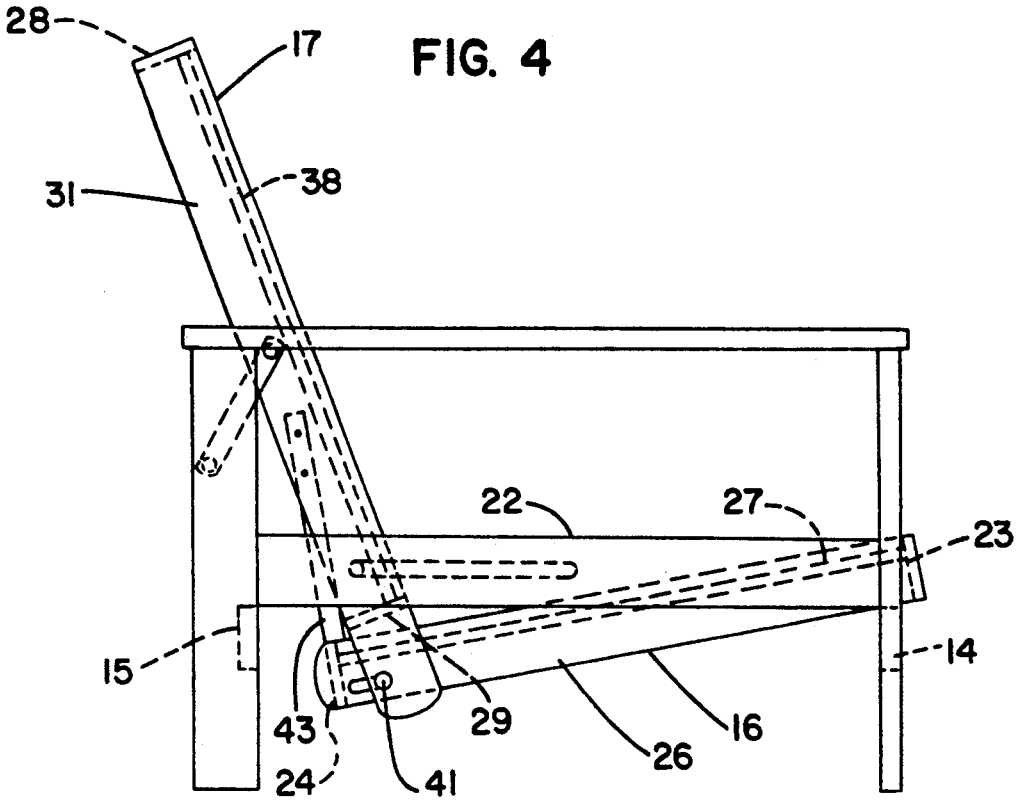
FIG. 4 is an end elevation of the convertible futon frame shown in the sitting position.
Figure 5:
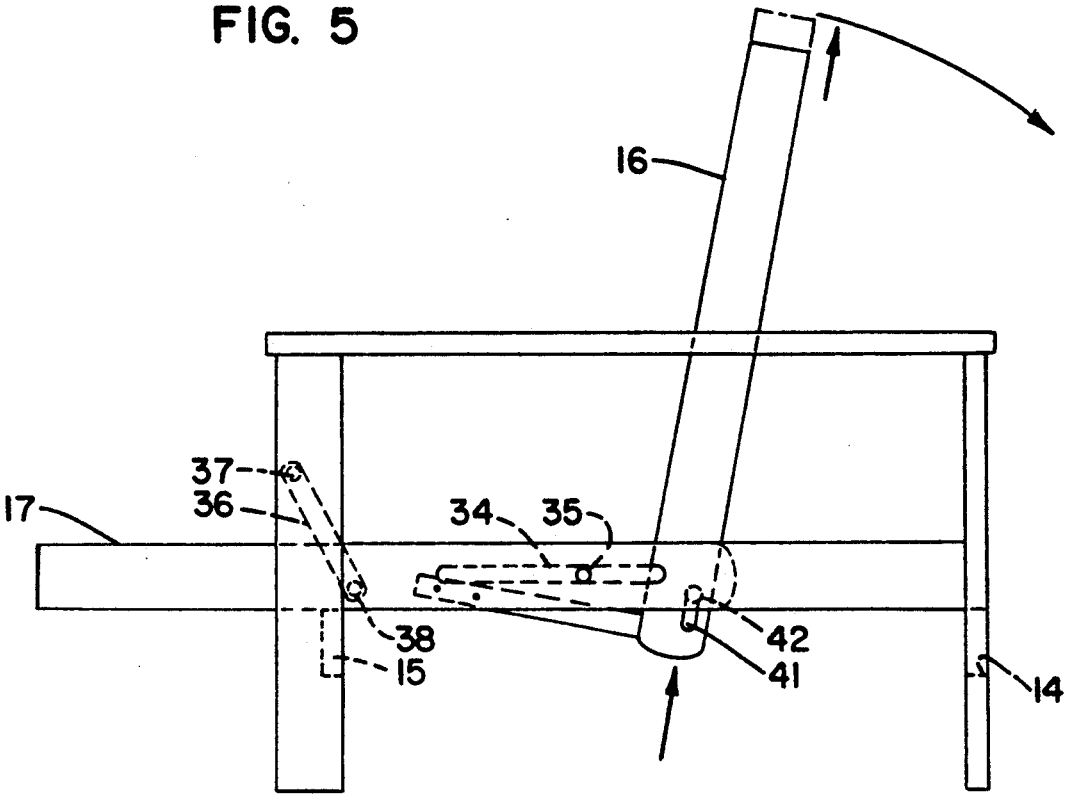
FIG. 5 is an end elevation showing the convertible futon frame being moved from a seat to a lying position.
Figure 6:
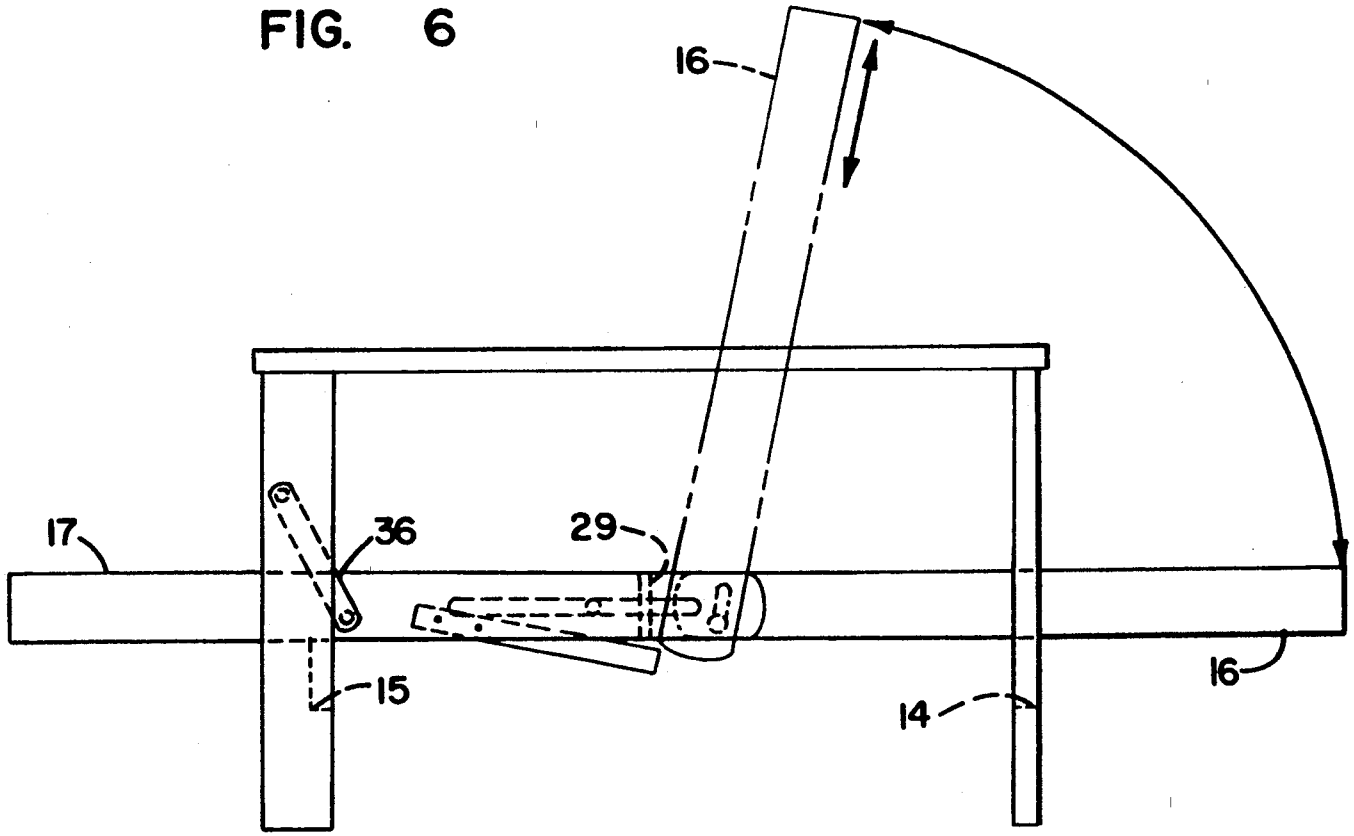
FIG. 6 is a an end elevation showing completion of the operational movement of the convertible futon frame to the lying position.

With initial reference to FIGS. 1 and 2, a convertible futon frame embodying the invention bears the general reference numeral 11. Futon frame 11 consists of first and second end frames 12, 13, each of which is adapted to rest stably on a support surface such as a floor. Front and back cross rails 14, 15 interconnect the end frames 12, 13 in parallel, spaced relation at the fronts and backs thereof. Cross rails 14, 15 are themselves disposed in parallel relation, and as best seen in FIGS. 4–6, cross rails 14, 15 also have upper edges that are disposed in the same horizontal plane.

Futon frame 11 further comprises a seat member 16 and a back member 17 that, in the general sense, are mounted between the end frames 12, 13 for selective movement between sofa (sitting) and bed (lying) positions. It will be noted that the length of the seat and back members 16, 17 is such that two or three individuals may be comfortably seated with the futon frame in the sofa position, and two adults may be accommodated in the bed position. The length of the seat and back members 16, 17 may be varied to form a chair and single sleeper, and such dimensions are not critical to the invention.

With continued reference to FIGS. 1 and 4–6, end frames 12, 13 are identical although mirror images. As such, the same reference numerals apply to the components of both, and only one will be described in detail.

End frame 12 comprises front and rear vertical legs 18, 19 interconnected by an arm member 21 and a cross rail 22.

The front cross rail 14 rigidly interconnects the respective front vertical legs 18 of end frames 12, 13, and rear cross rail 15 interconnects vertical legs 19. The end frames 12, 13 and cross rails 14, 15 thus define and form a rigid stationary frame on which the seat and back members 16, 17 are movably mounted.

With continued reference to FIGS. 1 and 4–6, seat member 16 is generally rectangular in shape, defining front and rear sides and opposed ends. It comprises elongated front and rear members 23, 24 interconnected by end members 25, 26 (see also FIG. 2). A plurality of slat members 27 are connected between the front and rear elongated members 23, 24, the upper faces of which are disposed in the same plane to define a seat support surface for individuals using the frame. It will be noted particularly in FIG. 4 that the upper faces of slat members 27 are slightly recessed relative to the upper edges of the members 23–26, and the resulting rectangular recess accommodates and retains a futon or other resilient cushion (not shown).

Back member 17 similarly is rectangular in shape, having front and rear sides and opposed ends. It comprises upper and lower elongated members 28, 29 interconnected by end members 31, 32. It will be particularly noted from FIG. 4 that lower elongated member 29 is spaced inwardly from the extreme lower end of the end members 31, 32 to accommodate the projection of the rear portion of seat member 16. Such construction lends itself to a stabler and more continuous support of individuals using the futon frame 11 in both the sofa and bed positions.

Back member 17 further comprises a plurality of slat members 33 interconnected between the upper and lower elongated members 28, 29. In the same manner as seat 16, the slat members 33 are disposed in planar relation to define a back support surface for individuals using the futon frame 11. The slats 33 are also recessed relative to the forward or top edge of the components 28, 29, 31, 32 to define a rectangular recess for accommodating and retaining a futon or other rectangular cushion.

Figure 3:
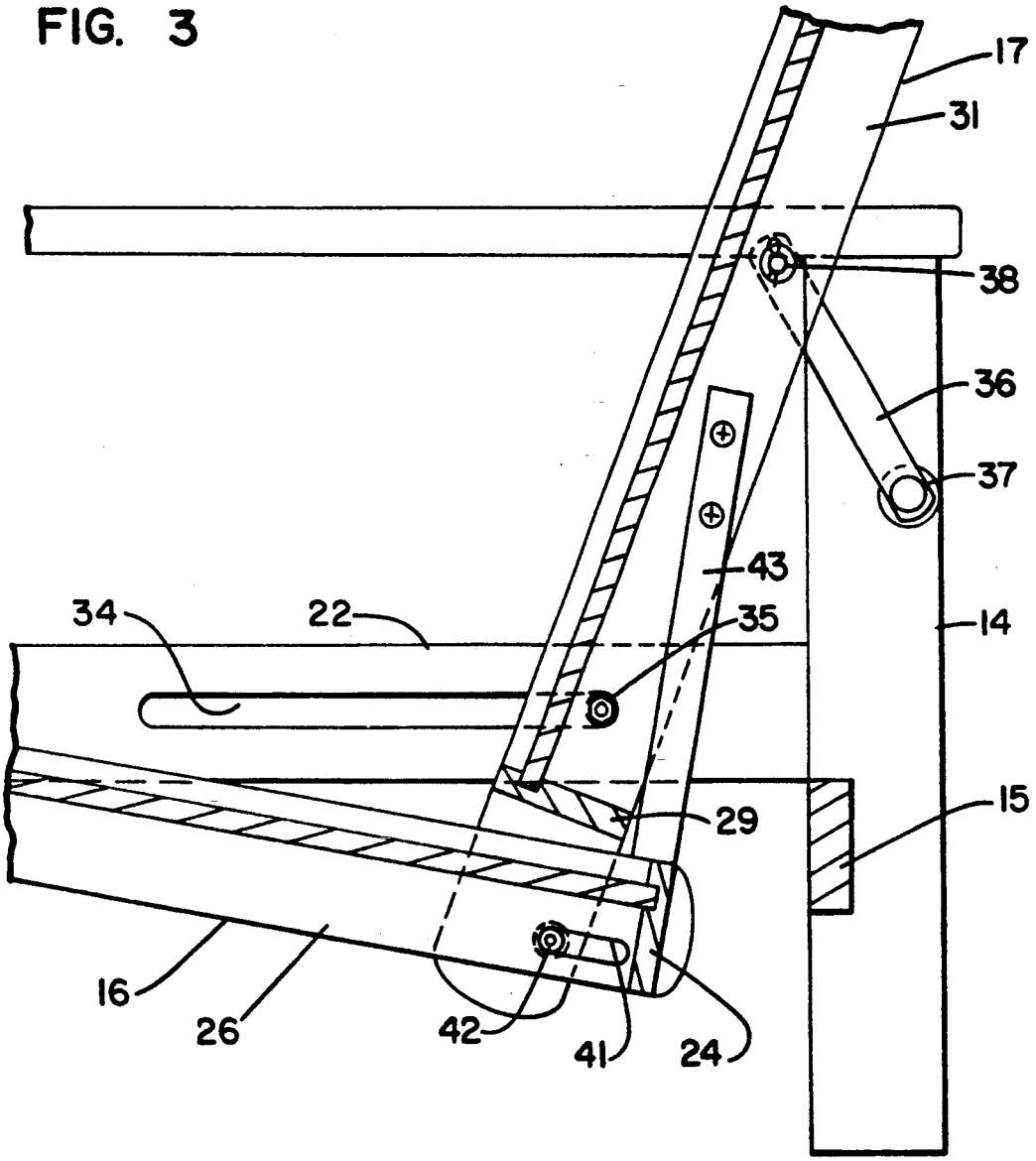
FIG. 3 is an enlarged fragmentary sectional view taken along the line 3—3 of FIG. 1.

With reference to FIGS. 3 and 4, the back member 17 is mounted for relative movement to the end frames 12, 13 in two manners. First, an elongated horizontal groove 34 is formed in the inner face of the cross rail 22 of each of the end frames 12, 13. In the preferred embodiment, and for aesthetic purposes, the elongated groove 34 does not extend through the entire thickness of the cross rails 22.

A pin member 35 is secured by suitable means to the inner face of each of the end members 31, 32 of back member 17. It will be noted that each of the pin members 35 is disposed generally at or proximate the lower end of back member 17, and each is disposed to project into the elongated groove 34 in guided relation thereto.

The second manner of mounting the back member 17 to the end frames 12, 13 takes the form of a pair of rigid straps or linkage member 36, each being pivotally connected between the associated rear vertical leg 19 on the inner face thereof and the outer face of the associated end member 31, 32 of back member 17. In other words, the two linkage members 36 are disposed between the respective sides of back member 17 and each of the end frames 12, 13. The pivotal connection of each of the linkage members 36 with rear vertical leg 19, which bears reference number 37, is stationary, and it will be noted that this pivoted connection is disposed above the cross rails 22. The pivotal connection of the linkage members 36 with each of the associated end members 31, 32 (see reference numeral 38) is movable with movement of the back member 17. With back member 17 in the sitting position shown in FIG. 3, pivot point 38 is above pivot point 37, and with back member 17 in the lying position shown in FIG. 5, pivot point 38 is below pivot point 37. It will also be observed that, based on the placement of pivotal connections 37, 38 and the length of linkage member 36, the linkage member 36 is substantially hidden from view in both the sofa and bed positions of FIGS. 3 and 5.

With reference to FIGS. 3 and 4, seat member 16 is supported along its rear side by the front side of back member 17 and at its front side by the front cross rail 14, whether in the sitting or lying position. The inner connection between the front side of back member 17 and the rear side of seat member 16 is pivotal, comprising a short groove 41 formed in each of the end members 25, 26. The short groove 41 is disposed toward the rear side of seat member 16 immediately in front of the rear member 24, and it extends linearly of the end members 25, 26. A pivot pin 42 is mounted at the lower end of each of the end members 31, 32, and each pin projects into the associated short groove 41.

It will be recalled that the lower elongated cross member 29 of back member 17 is recessed from its extreme lower edge, permitting the rear side of seat member 16 to project between the end members 31, 32 of back member 17 as shown.

An abutment member 43 is secured to the inner face of each of the end members 31, 32 of back member 17. As best shown in FIG. 3, abutment member 43 is elongated, and it is preferably formed from a length of hardwood because it is under a compressive load during conversion from the sleeping to the sitting position. As shown in FIG. 3, abutment member 43 is disposed at an angle relative to the end members 31, 32 which, in the preferred embodiment, is approximately 10 degrees. As such, and with pivot pins 42 at the forward end of short grooves 41, the abutment members 43 engageably abut the top edges of end members 25, 26 of the seat member 16 at substantially a right angle during conversion to the seating position. This prevents relative rotational movement between the seat and back members 16, 17 during this conversion step, and also defines the desired seat angle between these members at approximately 100 degrees. The abutment member 43 does not prevent relative rotational movement between seat and back members 16, 17 in the opposite direction; i.e., the angle between them in the sitting position may be closed (decreased) but not opened (increased).

The size and position of the abutment members 43 as well as the size and position of the groove/pin pairs 41, 42 permits relative rotation between the seat and back member 16, 17 when the pin 42 is moved to the back end of groove 41. In this position, abutment members 43 are moved out of engagement with the end members 25, 26, and relative rotation is therefore permitted.

It will be further noted from FIGS. 3 and 4 that, with the seat and back members 16, 17 in the sitting position, the pins 35 are at the rear end of grooves 34, which prevents further rearward movement of back member 17. As assisted by linkage members 36 and the forward edge of seat member 16 resting on the front cross rail 14, the seat and back members 16, 17 are in a stable and essentially locked position with respect to normal downward forces exerted on seat member 16 and rearward forces exerted on the back member 17. This stable position is enhanced by the presence of a futon or other resilient cushion placed on the seat and back members 16, 17.

When it is desired to move the futon frame 11 to a lying position from the sitting position, this can be easily accomplished by a single individual standing in a single position. Initially, the individual lifts and pulls the seat member 16 from along its lower edge (i.e., by the lower edge of cross rail 23), so that the seat and back members 16, 17 are rotated to the position shown in FIG. 5. Back member is prevented from falling by gravity by the abutment member 43. As this occurs, the linkage members 36 are rotated downward relative to pivot point 37 until pivot point 38 is lower than pivot point 37. Pins 35 move forwardly within the elongated horizontal grooves 34, but the relative position of pins 42 in short grooves 41 remains the same. As such, and as shown in FIG. 5, the back member 17 is now in a horizontal or lying position, resting on the upper edge of cross rail 15.

From this point, seat member 16 is lifted linearly as indicated by the arrows, which results in placement of the pins 42 at the rear (or now lower) end of the short groove 41. In this position, the lower or rearward end of seat member clears the abutment member 43, as shown in FIG. 6, and seat member 16 is permitted to freely rotate downward to the lying position shown. In this lying position, shifting linear movement of seat section 16 is prevented by the lower elongated member 29 of back section 17, which it now abuts, and the position of pin 42 at the rearmost point in short groove 41. In the sleeping position, back member 17 is rigidly supported at an intermediate point by the rear cross rail 15, and at its forward edge by the pin 35 resting in elongated groove 34. Rearward linear movement of the back member 17 is resisted due to the angle of linkage members 36 and the resulting wedging action of the back member 17 with rear cross rail 15. Upward rotational movement of the back member 17 is prevented by the straps 36, which have been rotated to an almost vertical position and thus provide a downward reactive force in response to any attempted upward rotational movement of back member 17.

Seat member 16 also rests at an intermediate point along the upper edge of front cross rail member 14. The inner edge or side of seat member 16 is rigidly locked in place by virtue of its connection to back member 17 through the short grooves/pins 41, 42. The fact that back member 17 is substantially locked in its horizontal position by the pins 35 and straps 36 as discussed above likewise means that the inner edge of seat member 16 cannot be lifted or rotated from this horizontal sleeping position. As such, in the sleeping position, both the seat and back members 16, 17 are in a rigid and stable position, and with placement of a futon or other resilient cushion, the unit serves as a bed.

To convert the futon frame 11 from a bed to a sofa, the reverse steps are followed. In other words, the seat member 16 is rotatably lifted by its outer edge from the lying position to the upward position shown in FIG. 6, and it is then moved linearly downward (which is easily accomplished because the assistance of gravity) until pins 42 are positioned at the forward end of short grooves 41 as shown in FIG. 5. As shown, the lower end of seat member 16 re-engages abutment member 43, which now prevents relative rotational opening movement between the seat and back members 16, 17. The members 16, 17 are then rotated together by pulling forward and down on the forward or outer edge of seat member 16. This movement is guided by the pin/elongated groove pairs 34, 35 and the linkage members 36, until the frame 11 reaches its stable sitting position as shown in FIG. 4.

Figure 7:
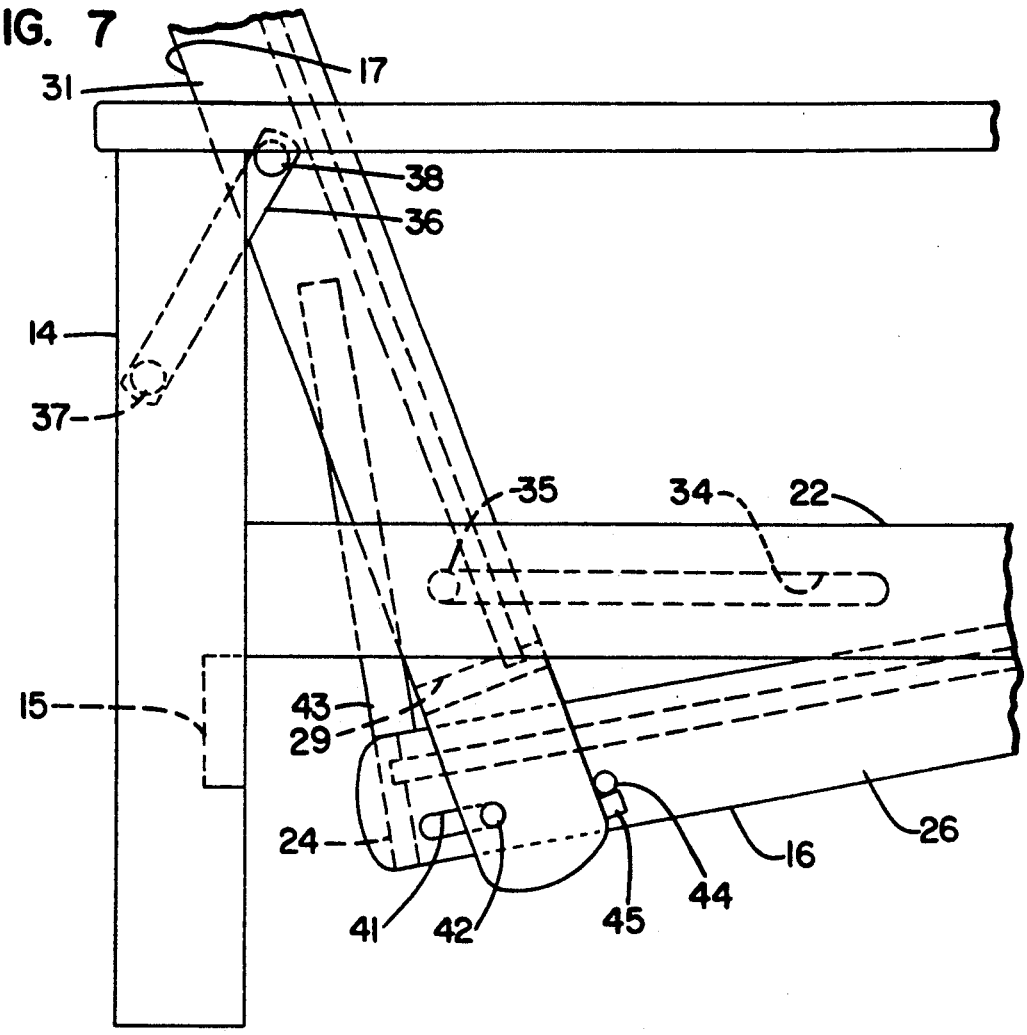
FIG. 7 is a fragmentary view similar to FIG. 3, although from the opposite side, of an alternative construction of the conversion mechanism.
Figure 8:
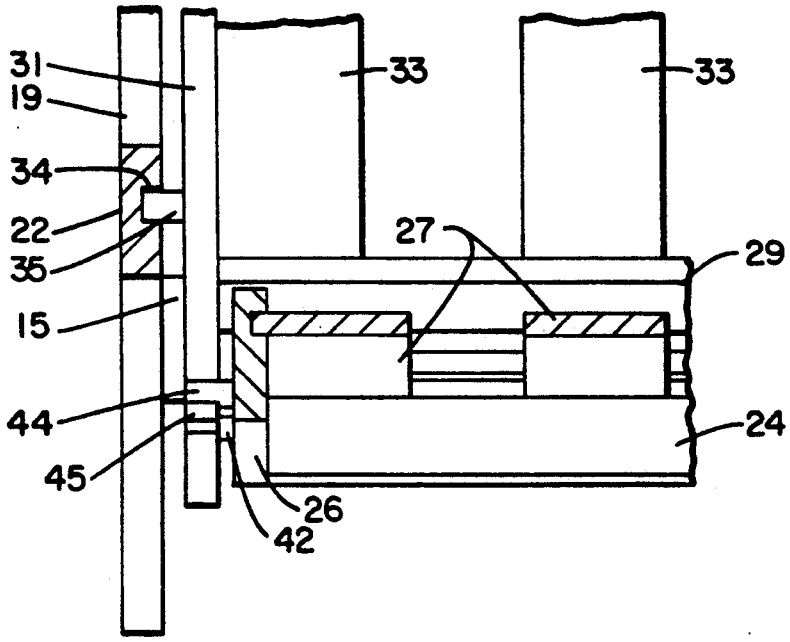
FIG. 8 is an enlarged fragmentary sectional view of the alternative construction as viewed from the front of the frame.
Figure 9:
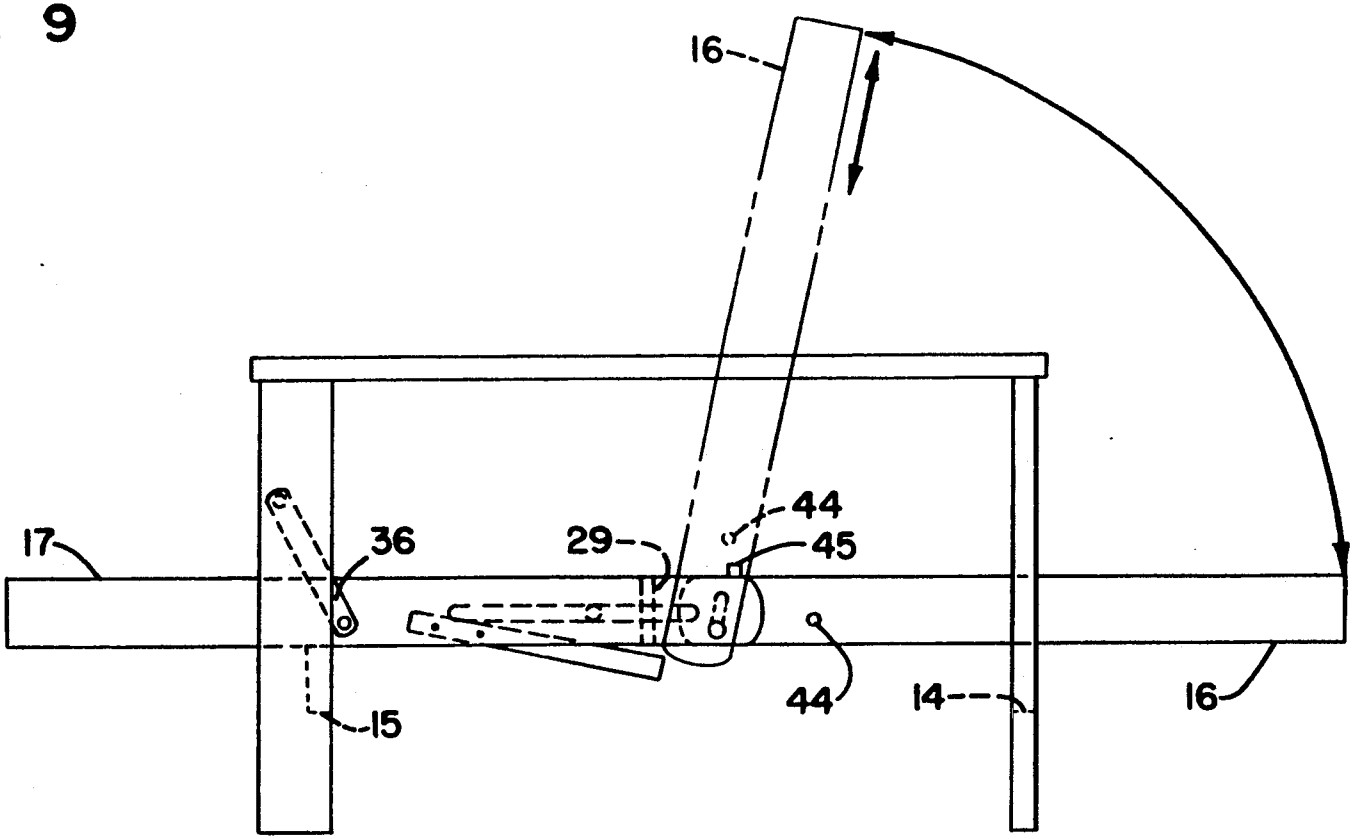
FIG. 9 is a fragmentary view similar to FIG. 6 showing the alternative construction.

An alternative construction for the conversion mechanism is shown in FIGS. 7–9. In these figures, components corresponding to those of the embodiment of FIGS. 1–6 bear like reference numerals, and additional components bear new reference numerals.

With reference to FIGS. 7–9, a first pin 44 projects laterally outward from the side face of each of the end members 25, 26 of seat member 16. The pins 44 are disposed generally toward the inner end of members 25, 26 and intermediate the upper and lower edges thereof. Because they act as bearing points, they are preferably formed from metal or a combination of metal with a nylon outer bearing surface.

A second pin 45, also preferably formed from metal or a combination of metal with a nylon outer bearing surface, projects forwardly from the front edge of each of the end members 31, 32 of back member 17. The pins 45 are disposed at the lower ends of the members 31, 32 and engage the associated pins 44 when the seat and back members 16, 17 are in the sitting position (FIGS. 7 and 8). As best shown in FIG. 7, this engagement of pins 44, 45 strengthens the connection between the seat and back members 16, 17 in the sitting position by moving the points of leverage apart and by causing the end members 31 to be compressed in the engaged position. This reduces the likelihood that one of the end members 31 will split laterally from the pin 42. The pins 44, 45 thus strengthen the interconnection between seat and back members 16, 17, and also permit weaker woods to be used to construct the frame.

As constructed, the futon frame 11 of both embodiments is easily converted by a single individual between sitting and lying positions, and the frame stably and comfortably supports users in both positions.

What is claimed is:

1. A convertible furniture frame capable of being converted between sitting and lying positions, comprising:

first and second end frame means, each adapted to rest stably on a support surface and each defining a front and back;

cross frame means for interconnecting the first and second end frame means in spaced relation;

substantially rigid seat and back members capable of being relatively disposed and moved between sitting and lying positions, each of said seat and back members comprising opposed front and rear sides and opposed ends and each defining a surface for supporting individuals in each of said sitting and lying positions;

said cross frame means constructed and arranged to provide partial support to the seat member in the sitting and lying positions;

means for movably mounting the back member to and between the end frame means for movement between sitting and lying positions, comprising:

first connection means for permitting substantially horizontal linear movement on one of the opposed sides of the back member relative to said end frame means, said first connection means also permitting pivotal movement of the first back member relative to the end frame means substantially about said one opposed side; and substantially rigid linkage means pivotally connected between each of said end frame means and an associated end of the back member, the pivotal connection with said associated end being disposed below the pivotal connection with the end frame means with the seat member in the lying position;

second connection means for pivotally connecting the back and seat members between respective front and rear sides thereof for relative rotational movement between said sitting and lying positions, and for permitting limited relative linear movement of the seat member relative to the back member between first and second linear positions respectively corresponding to the sitting and lying positions; and means for preventing relative rotational movement between the seat and back members with the seat member in the first linear position, and for permitting relative rotational movement therebetween with the seat member in the second linear position.

2. The convertible furniture frame defined by claim 1, wherein the seat and back members are generally rectangular in configuration.

3. The convertible furniture frame defined by claim 1, wherein the first connection means comprises:

horizontal groove means formed in each of said end frame means; and pin means for each of said groove means, said means projecting laterally from each of the opposed ends of the back member.

4. The convertible furniture frame defined by claim 3, wherein each of said end frame means comprises a pair of substantially vertical legs interconnected by a cross rail member having an inner face, the horizontal groove means is formed in the inner face of said cross rail member, and the pin means project laterally outward from each of said opposed ends.

5. The convertible furniture frame defined by claim 1, wherein said cross frame means comprises first and second cross rail members interconnecting the first and second end frame means in space relation at the respective fronts and backs thereof, said first and second cross rail members being disposed in substantially the same horizontal plane.

6. The convertible furniture frame defined by claim 25, wherein said horizontal groove means is disposed above the horizontal plane of said first and second cross rail members.

7. The convertible furniture frame defined by claim 1, wherein the pivotal connection of said substantially rigid linkage means with said associated end is disposed above the pivotal connection with the end frame means with the seat member in the sitting position.

8. The convertible furniture frame defined by claim 1, wherein each of said linkage means comprises an elongated linkage member.

9. The convertible furniture frame defined by claim 1, wherein the second connection means comprises:

groove means formed in each of the opposed ends of said seat member proximate one opposed side thereof; and pin means for each of said groove means, said pin means projecting laterally from each of the opposed ends of said back member.

10. The convertible furniture frame defined by claim 9, wherein each of the groove means is formed in the outer face of the associated opposed end of the seat member, and each of the pin means projects laterally inward from the associated opposed end of the back member.

11. The convertible furniture frame defined by claim 1, wherein the means for preventing relative rotational movement comprises abutment means mounted to the back member and disposed for abuttable engagement with the seat member when the seat member is in said first linear position, said abutment means being moved into a position of nonengagement with the seat member in said second linear position.

12. The convertible furniture frame defined by claim 11, wherein the abutment means comprises an abutment member secured to each of the opposed ends of the back member and disposed for abuttable engagement with the associated opposed end of the seat member.

13. The convertible furniture frame defined by claim 12, wherein said abutment members and said opposed ends of each of said seat and back members are elongated in configuration, each defining a predetermined longitudinal axis, said abutment members and opposed ends of the seat members being mutually orthogonal in the sitting position, and the opposed ends of the seat and back members being disposed at about 100 degrees in said sitting position.

14. The convertible furniture frame defined by claim 1, wherein the means for preventing relative rotational movement comprises:

a first abutment means projecting laterally from each of the opposed ends of the seat member; and a second abutment means projecting forwardly from each opposed end of the back member;

said first and second abutment means being mutually engaged with the seat member in said first linear position, and said first and second abutment means being in a position of nonengagement with the seat member in said second linear position.

15. The convertible furniture frame defined by claim 14, wherein:

each of said opposed ends of said seat and back members comprises an elongated member having opposed faces and edges;

each of said first abutment means comprises a pin member projecting laterally outward from the outer face of the associated end member; and each of said second abutment means comprises a pin member projecting forward from the forward edge of the associated end member.

16. The convertible furniture frame defined by claim 1, wherein:

said first connection means is constructed and arranged to prevent upward movement of one opposed side of the back member when the back member is in said lying position; and said linkage means is constructed and arranged to prevent upward movement of the other opposed side of the back member when the back member is in said lying position.

17. The convertible furniture frame defined by claim 1, wherein the means for preventing rotational movement is constructed and arranged so that, with the seat member in the first linear position, the seat and back members are prevented from angularly opening while being permitted to angularly close.

18. A convertible furniture frame capable of being converted between sitting and lying positions, comprising:

first and second end frame means, each adapted to rest stably on a support surface and each defining a front and back;

cross frame means for interconnecting the first and second end frame means in spaced relation;

substantially rigid seat and back members capable of being relatively disposed and moved between sitting and lying positions, each of said seat and back members comprising opposed front and rear sides and opposed ends, and each defining a surface for supporting individuals;

said cross frame means being constructed and arranged to provide partial support to the seat member in the sitting and lying positions;

means for movably mounting the back member to and between the first and second end frame means for movement between said sitting and lying positions, comprising: with the seat member in the first linear position, and for permitting relative rotational movement therebetween with the seat member in the second linear position, the means for preventing relative rotational movement comprising abutment means mounted to the back member and disposed for abuttable engagement with the seat member at a predetermined area thereon when the seat member is in said first linear position, said area of abuttable engagement being disposed rearwardly from said predetermined pivot point, and said abutment means being moved into a position of nonengagement with the seat member in said second linear position.

19. The convertible furniture frame defined by claim 18, wherein the cross frame means comprises first and second cross rail members interconnecting the first and second end frame means in spaced relation at the respective fronts and backs thereof, said first and second cross rail members being disposed in substantially the same horizontal plane.

20. The convertible furniture frame defined by claim 25, wherein the abutment means comprises an abutment member secured to each of the opposed ends of the back member and disposed for abuttable engagement with the associated opposed end of the seat member.

21. The convertible furniture frame defined by claim 20, wherein said abutment members and said opposed ends of each of said seat and back members are elongated in configuration, each defining a predetermined longitudinal axis, said abutment members and opposed ends of the seat members being mutually orthogonal in the sitting position, and the opposed ends of the seat and back members being disposed at about 100 degrees in said sitting position.

22. A convertible furniture frame capable of being converted between sitting and lying positions, comprising:

first and second end frame means, each adapted to rest stably on a support surface and each defining a front and back;

cross frame means for interconnecting the first and second end frame means in spaced relation;

substantially rigid seat and back members capable of being relatively disposed and moved between sitting and lying positions, each of said seat and back members comprising opposed front and rear sides and opposed ends, and each defining a surface for supporting individuals;

said cross frame means being constructed and arranged to provide partial support to the seat member in the sitting and lying positions;

means for movably mounting the back member to and between the first and second end frame means for movement between said sitting and lying positions, comprising:

first connection means for permitting substantially horizontal linear movement of the front side of said back member relative to said end frame means, said first connection means also permitting pivotal movement of the back member relative to the end frame means substantially about the front side; and substantially rigid linkage means pivotally connected between each of said end frame means and an associated end of the back member;

second connection means for pivotally connecting the back and seat members between respective front and rear sides thereof for relative rotational movement about a predetermined pivot point between said sitting and lying positions, and for permitting limited relative linear movement of the seat member relative to the back member between first and second linear positions relatively corresponding to the sitting and lying positions; and means for controlling relative rotational movement between the seat and back members which is constructed and arranged so that, with the seat member in the first linear position, the seat and back members are prevented from angularly opening while being permitted to angularly close, and with the seat member in the second linear position the seat and back members are permitted to angularly open and close.

23. The convertible furniture frame defined by claim 22, wherein said means for controlling relative rotational movement comprises abutment means mounted to the back member and disposed for abuttable engagement with the seat member at a predetermined area thereon when the seat member is in said first linear position, said area of abuttable engagement being disposed remote from said predetermined pivot point, with said abutment means being moved into a position of nonengagement with the seat member in said second linear position.

24. The convertible furniture frame defined by claim 23, wherein the abutment means comprises an abutment member secured to each of the opposed ends of the back member and disposed for abuttable engagement with the associated opposed end of the seat member.

25. The convertible furniture frame defined by claim 22, wherein the means for controlling relative rotational movement comprises:

a first abutment means projecting laterally from each of the opposed ends of the seat member; and a second abutment means projecting forwardly from each opposed end of the back member;

said first and second abutment means being mutually engaged with the seat member in said first linear position, and said first and second abutment means being in a position of nonengagement with the seat member in said second linear position.

26. The convertible furniture frame defined by claim 25, wherein:

each of said opposed ends of said seat and back members comprises an elongated member having opposed faces and edges;

each of said first abutment means comprises a pin member projecting laterally outward from the outer face of the associated end member; and each of said second abutment means comprises a pin member projecting forward from the forward edge of the associated end member.

27. A convertible furniture frame capable of being converted between sitting and lying positions, comprising:

first and second end frame means, each adapted to rest stably on a support surface and each defining a front and back;

cross frame means for interconnecting the first and second end frame means in spaced relation;

substantially rigid seat and back members capable of being relatively disposed and moved between sitting and lying positions, each of said seat and back members comprising opposed front and rear sides and opposed ends and each defining a surface for supporting individuals in each of said sitting and lying positions;

means for movably mounting the back member to and between the end frame means for movement between sitting and lying positions, comprising:

first connection means for permitting substantially horizontal linear movement of one of the opposed sides of the back member relative to said end frame means, said first connection means also permitting pivotal movement of the first back member relative to the end frame means substantially about said one opposed side; and substantially rigid linkage means pivotally connected between each of said end frame means and an associated end of the back member, the pivotal connection with said associated end being disposed below the pivotal connection with the end frame means with the seat member in the lying position;

second connection means for pivotally connecting the back and seat members between respective front and rear sides thereof for relative rotational movement between said sitting and lying positions.

* * * * *